US005943984A

United States Patent [19]

Lannes

[11] Patent Number: 5,943,984

[45] Date of Patent: Aug. 31, 1999

[54] SIDE INLET FOR A WATER HEATER

[75] Inventor: Eric M. Lannes, Kentwood, Mich.

[73] Assignee: Bradford White Corporation, Ambler, Pa.

[21] Appl. No.: 08/865,006

[22] Filed: May 29, 1997

[51] Int. Cl.[6] ..... F22B 37/52

[52] U.S. Cl. ..... 122/392; 122/383; 122/390; 122/13.1; 138/37

[58] Field of Search ..... 285/53, 55; 137/360; 138/37, 11, 177, 178, 392; 122/13.1, 13.2, 17, 390, 383; 239/518, 521, 590, 602

[56] References Cited

U.S. PATENT DOCUMENTS

| | | | |
|---|---|---|---|
| 241,360 | 5/1881 | Hayes et al. . | |
| 349,046 | 9/1886 | Hooker . | |
| 1,790,357 | 1/1931 | Stack . | |
| 2,123,809 | 7/1938 | Seitz . | |
| 2,592,863 | 4/1952 | Conner . | |
| 2,602,465 | 7/1952 | Goehring . | |
| 2,766,200 | 10/1956 | Kaufman . | |
| 2,825,464 | 3/1958 | Mack . | |
| 3,229,683 | 1/1966 | Russell et al. . | |
| 3,465,123 | 9/1969 | Harris . | |
| 3,726,475 | 4/1973 | Eising | 236/102 |
| 3,762,395 | 10/1973 | Taylor . | |
| 3,776,456 | 12/1973 | Eising | 236/93 |
| 4,083,583 | 4/1978 | Volgstadt et al. | 285/55 |
| 4,157,077 | 6/1979 | Lindahl . | |
| 4,206,779 | 6/1980 | Sandstrom | 137/360 |
| 4,216,092 | 8/1980 | Shalhoob et al. . | |
| 4,257,355 | 3/1981 | Cook . | |
| 4,263,879 | 4/1981 | Lindahl . | |
| 4,332,401 | 6/1982 | Stephenson et al. | 285/53 |
| 4,340,245 | 7/1982 | Stalder | 285/53 |
| 4,398,754 | 8/1983 | Caroleo et al. | 285/53 |
| 4,505,231 | 3/1985 | Syler . | |
| 4,512,289 | 4/1985 | Collins . | |
| 4,549,525 | 10/1985 | Narang . | |
| 4,662,314 | 5/1987 | Moore, Jr. . | |
| 4,714,053 | 12/1987 | Perry . | |
| 4,735,174 | 4/1988 | Crump . | |
| 4,790,289 | 12/1988 | Barrett . | |
| 4,790,291 | 12/1988 | Barrett . | |
| 4,813,383 | 3/1989 | Daugirda . | |
| 4,817,564 | 4/1989 | Akkala et al. . | |
| 4,838,211 | 6/1989 | Vago . | |
| 4,854,613 | 8/1989 | Reece et al. | 285/55 |
| 4,858,563 | 8/1989 | Perry . | |
| 4,870,927 | 10/1989 | Sundheimer . | |
| 4,898,124 | 2/1990 | Granberg et al. . | |
| 4,898,150 | 2/1990 | Lewis . | |
| 4,905,900 | 3/1990 | Scharton et al. . | |
| 4,911,108 | 3/1990 | Akkala et al. . | |
| 4,949,680 | 8/1990 | Kale . | |
| 4,951,614 | 8/1990 | Akkala et al. . | |
| 4,964,394 | 10/1990 | Threatt . | |
| 4,972,804 | 11/1990 | Stolmar . | |
| 5,152,843 | 10/1992 | McDonald et al. . | |
| 5,222,770 | 6/1993 | Helevirta | 285/53 |
| 5,277,171 | 1/1994 | Lannes | 126/362 |
| 5,341,770 | 8/1994 | Lannes . | |
| 5,348,779 | 9/1994 | Igarashi | 285/55 |
| 5,365,891 | 11/1994 | Hanning . | |

FOREIGN PATENT DOCUMENTS

| | | |
|---|---|---|
| B 17117/76 | 5/1979 | Australia . |
| 132112 | 1/1985 | European Pat. Off. . |
| 2.183.339 | 12/1973 | France . |
| 90 07 115 U | 8/1990 | Germany . |

*Primary Examiner*—Teresa Walberg
*Assistant Examiner*—Jiping Lu
*Attorney, Agent, or Firm*—Austin R. Miller

[57] ABSTRACT

An inlet is provided for delivering water into a water heater through a port in its side. The inlet includes a conduit having a distal portion that extends toward a bottom of the water heater. That portion includes means for deflecting the water flow in order to reduce the generation of temperature gradients that otherwise tend to develop within water heater tanks. A water heater assembly including such an inlet is also described.

29 Claims, 4 Drawing Sheets

SIDE INLET FOR A WATER HEATER

BACKGROUND OF THE INVENTION

This invention relates to an inlet for a water heater and particularly to a side inlet adapted to reduce the generation of temperature gradients within the water heater.

FIELD OF THE INVENTION

The generation of temperature gradients in water heaters above the desired outlet temperature represents a serious problem. Heating of water promotes the precipitation of sediment, and excessive temperature gradients tend to accelerate sediment precipitation. Accumulated sediment tends to harden, forming a scale on various tank surfaces, which reduces water heater efficiency and, in many cases, can lead to failure.

Also, excessive temperature gradients tend to cause excessive temperature fluctuations. Such fluctuations bring about undue fatigue of the water heater tank and can reduce water heater longevity.

Furthermore, excessive temperature gradients within the water heater's tank can tend to reduce the draw-off ability of the water heater and can decrease the water heater's response time. Both of these conditions compromise water heater efficiency.

Various side inlets have been introduced over the years in an attempt to overcome one or more of these problems. U.S. Pat. No. 4,257,355, issued to Robert E. Cook, describes a cold water inlet tube with several nozzles to provide jet-like discharges of incoming cold water downwardly at an angle in the general direction of the tank's bottom. A nozzle is also provided at the top of the inlet tube to discharge a jet of cold water upwardly toward the hot water stored in the upper portion of the tank. The angular nozzles in the bottom of the tube are intended to agitate any sediment tending to be deposited on the tank's bottom while the upwardly directed nozzle is intended to reduce stacking. Nevertheless, there remains a demand for improved side inlets.

OBJECTS OF THE INVENTION

It is an object of the invention to provide a side inlet for a water heater that is capable of overcoming the disadvantages associated with conventional side inlets.

It is another object of the invention to provide a side inlet adapted to reduce the generation of temperature gradients that tend to develop in water heater tanks.

It is still another object of the invention to provide a side inlet adapted to increase water heater efficiency.

It is yet another object of the invention to provide a cost effective side inlet that is easy to install.

Other objects of the invention will become clear from the drawings and descriptions that follow.

SUMMARY OF THE INVENTION

Figure 1:
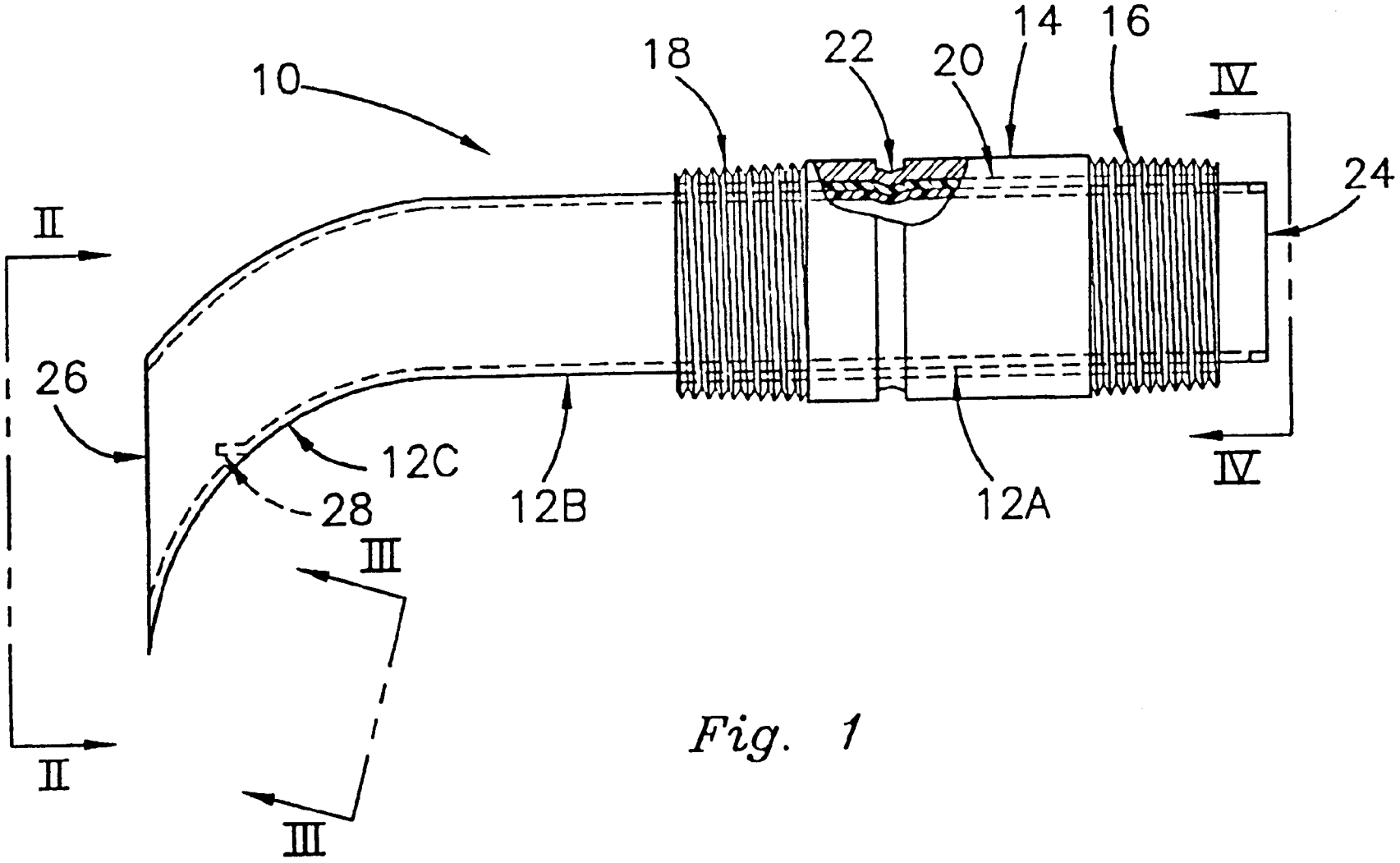
FIG. 1 is a side view of an embodiment of a side inlet according to this invention.

This invention relates to an inlet adapted for delivering water into a water heater tank through a side port. The inlet includes a conduit having a proximal portion with a flow opening for water flow into the inlet from a water source. The conduit also includes an intermediate portion that extends from the proximal portion to a distal portion, which includes a flow opening for water flow from the conduit into the tank. The proximal, intermediate and distal portions together define a flow passage. Means such as a deflector is provided within the distal portion of the conduit. It extends into the flow passage for deflecting the water flow.

After installation of the inlet into the water heater tank, the proximal portion of the conduit extends through the tank's side port, the intermediate portion extends toward an interior region of the tank and the distal portion extends downward toward a bottom of the tank. As water flows into the tank, the distal portion of the conduit and the deflecting means co-act to reduce the generation of temperature gradients in the tank.

This invention also relates to a water heater that is adapted to reduce the generation of such temperature gradients. It includes an inlet conduit, as described, as well as a fitting for engaging the inlet conduit to the tank's side port. The water heater is capable of reduced temperature gradients in accordance with an object of this invention.

DETAILED DESCRIPTION OF THE INVENTION

The following description is intended to refer to specific embodiments of the invention illustrated in the drawings. While a specific configuration has been selected for illustration, the flow pattern of incoming water is highly effective with various modifications. This description is not intended to define or limit the scope of the invention, which is defined separately in the claims that follow. Also, it will be appreciated that the drawings are not necessarily to scale and are merely provided for the purpose of illustration.

Generally speaking, the invention relates to an inlet adapted for delivering cold water into the storage tank of a water heater through a side port. Although the invention has been discovered to be highly beneficial for use in gas-fired water heaters that are intended for commercial use, the inlet is highly effective in electric, oil-fired and any other residential or commercial water heaters.

The inlet includes a conduit that is sized and shaped to be installed through the side port of a water heater. It has a proximal portion that is to be connected to the tank's side port by means of a fitting. Extending from the proximal portion is an intermediate portion that is intended to be positioned within the tank so that it extends from the side port and preferably toward a central region of the tank's interior, most preferably toward the central, vertical axis of the water heater. From the end of the intermediate portion extends a distal portion that terminates at a flow opening for introducing water from the conduit and into the tank's interior.

Upon installation of the inlet into the water heater's tank, the proximal portion of the inlet conduit preferably extends through the tank's side port. The intermediate portion preferably extends toward the tank's interior. Most preferably, the intermediate portion is horizontal or near horizontal so that it extends toward the tank's interior in a plane that is substantially parallel to the tank's bottom. The distal portion preferably extends downwardly toward the bottom of the tank. From the downstream end of the intermediate portion, the conduit's distal portion most preferably curves downwardly toward the tank's bottom surface. Such curvature is preferably gradual so that the conduit can easily be formed by a bending process, if desired.

The flow opening through which water flows from the inlet is positioned at the downstream end of the distal portion. The opening is preferably oriented at some angle to the axis of the distal portion. In other words, the flow opening preferably lies in a plane that is at an angle to the distal portion's axis; most preferably an acute angle such that the opening generally faces the central region of the tank's interior.

The inlet conduit is preferably provided with a substantially tubular shape with a substantially constant cross-sectional area for the flow passage that extends through the proximal, intermediate and distal portions and through the flow opening. The preferred inlet conduit defines a substantially continuous flow passageway extending from a proximal end outside the tank to a distal end oriented toward the tank's bottom central region.

A means, such as one or more flow deflectors or an equivalent structure, is connected adjacent to and within the distal portion of the inlet conduit and is positioned to extend into the water flow path in order to deflect the water flow as it travels through the inlet conduit toward the tank's interior. In a preferred embodiment, the means for deflecting the water flow includes an angled surface positioned adjacent to the distal portion's wall and extending within the distal portion into the water flow path. The means can be any deflector or element that redirects or disturbs the water flow as it passes through the distal portion toward the tank's interior. Most preferably, it takes the form of a tab that is connected in the distal portion's wall and that extends toward the central axis of the conduit. Although such a preferred tab may be located adjacent to a hole in the distal portion's wall, perhaps a hole created by forming the tab, it is not necessary for such a hole to exist and the conduit's end opening may be the only opening. Also, although the means for deflecting the water flow is preferably integral with the inlet conduit or the wall thereof, it can be formed from a separate component that is attached to the distal portion by a fastener, snap-in or press-fit engagement, weld, threads, or any other known or equivalent fastening means.

A threaded fitting is preferably used to connect the inlet conduit to the tank's side port. In a preferred embodiment, a threaded fitting is engaged over the proximal portion of the inlet conduit so that it can be threaded into a spud attached to the water heater tank's wall. The fitting is preferably engaged to the inlet conduit so that longitudinal movement of the inlet conduit through the fitting is prevented although rotational movement of the inlet conduit about the conduit's axis is permitted. In a preferred structure, this is accomplished by forming a ring-type groove in the outer surface of the fitting in order to create a radially inwardly extending surface within the fitting that can capture the conduit. It is this ring groove that prevents such longitudinal movement while permitting rotational movement.

Such rotational movement of the conduit in the fitting confers a significant benefit because the downward orientation of the conduit's distal portion should be maintained for optimal performance of the inlet and because this orientation will change as the fitting is threaded into the tank. Accordingly, a means is preferably provided for rotating the conduit in the fitting to adjust the orientation of the distal portion. The means may include a recess, such as a slot for example, or any surface positioned near or at the proximal end of the conduit. Engagement of such a surface facilitates the conduit's rotation after the fitting is threaded into the spud. A visual indicator is preferably provided to indicate the orientation of the conduit from outside of the tank.

In another preferred feature of the invention, the proximal end of the inlet conduit extends outwardly beyond the proximal end of the fitting. This preferred feature provides unobstructed access to the proximal end of the conduit for rotational adjustment. Also, when a source of cold water is connected to the proximal end of the fitting to make the necessary connection, the proximal end of the inlet conduit extends outwardly beyond the end of the fitting. It has been discovered that water flow from the source into the inlet is directed toward the central interior region of the inlet. Such flow reduces the wear and erosion that can otherwise be caused when flowing water directly impacts against the fitting. Instead, a buffer of slow-moving water is trapped adjacent to the fitting's end. Such a preferred feature is especially desirable when dielectric insulation is positioned between the fitting and the conduit. The preferred extension of the conduit beyond the fitting's end prevents accelerated erosion of the dielectric insulation.

Referring to FIGS. 1–5, a preferred embodiment of an inlet according to this invention, designated by the numeral "10", will now be described. FIG. 1 shows a side view of inlet 10 having an inlet conduit with a proximal portion 12A, an intermediate portion 12B extending from the downstream end of the proximal portion, and a distal portion 12C that extends from the downstream end of the intermediate portion 12B to the end of the inlet conduit. Together, portions 12A, 12B and 12C define a continuous flow passageway with a tubular cross-section, although other cross-sections are contemplated as well. In this embodiment, portions 12A and 12B share the same axis, and portion 12B is substantially an extension of portion 12A. The axis of portion 12C curves downwardly from that of portions 12A and 12B. The inlet conduit can be formed from plastic or metal, as desired.

Engaging the proximal portion 12A of the conduit is a fitting 14 that is preferably formed from a metal such as steel. Fitting 14 includes male pipe threads 16 and 18 at each end. Pipe thread 16 is used for water-tight connection to a source of cold inlet water (not shown). Pipe thread 18 is intended for threaded engagement of fitting 14 into the spud of a water heater's storage tank (not shown in FIG. 1). Within fitting 14, and captured between fitting 14 and the inlet conduit, is a dielectric insulator 20, preferably in the form of an insulating polymeric tube. Dielectric insulator 20 provides dielectric isolation between the metallic fitting 14 and the inlet conduit.

A ring-type groove 22 is formed in the outer surface of fitting 14 by known manufacturing methods. The groove 22 provides the interior surface of fitting 14 with a radially inwardly extending surface that captures dielectric insulator 20 as well as proximal portion 12A of the inlet conduit. A ring groove is preferably used to serve this purpose because it prevents longitudinal movement of the inlet conduit through fitting 14, along its axis. At the same time, groove 22 permits rotational movement of the inlet conduit with respect to the fitting 14 so that their relative positions can be adjusted. A proximal end 24 of the inlet conduit extends outwardly beyond the proximal end of the fitting 14 in the preferred embodiment for the reasons set forth in the general description of the invention.

At the other end of the inlet conduit, an opening 26 is provided at the downstream end of distal portion 12C. In this preferred embodiment, opening 26 occupies a plane that is substantially vertical and normal to the axis of portions 12A and 12B. It is most preferably oriented at an acute angle with respect to the axis of distal portion 12C. The opening 26 extends entirely across the distal portion 12C and, when viewed from the left in FIG. 1, it has a cross-sectional area at least as large as the cross-sectional area of the flow passageway through the inlet conduit.

One possible form of a deflector or deflecting means is designated with the numeral "28", although many other possible forms and configurations are contemplated. In this embodiment, deflector 28 is integrally connected to the interior, lower surface of distal portion 12C of the inlet conduit. Deflector 28 extends inwardly toward the central region of the flow passageway in order to deflect the water flow and to cooperate with the inlet conduit to reduce the generation of temperature gradients within the water heater.

Figure 3:
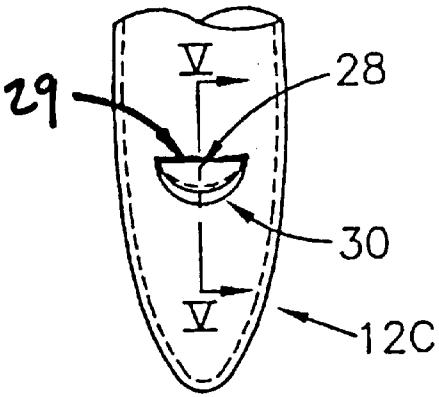
FIG. 3 is a rear end view of a portion of the side inlet shown in FIG. 1.
Figure 2:
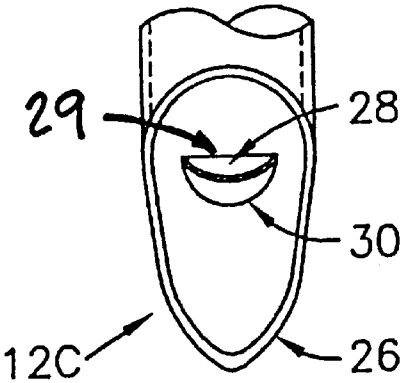
FIG. 2 is a front end view of a portion of the side inlet shown in FIG. 1.

Further details of preferred deflector 28 will now be described with reference to FIGS. 2, 3 and 5. Deflector 28, in this embodiment, takes the form of an integral semi-circular tab that is cut into the wall of the inlet conduit and bent along a fold line 29 toward the conduit's central axis. In so doing, an opening 30 is created in the conduit's wall adjacent to and downstream of deflector 28. Although such an opening may be preferred, it is important to note that deflector 28 can be formed in a wide variety of manners both with and without the formation of a hole in the conduit's wall. In fact, deflector 28 can be formed as an entirely separate component that can be attached to, or mounted within, the distal portion 12C of the inlet conduit.

Figure 5:
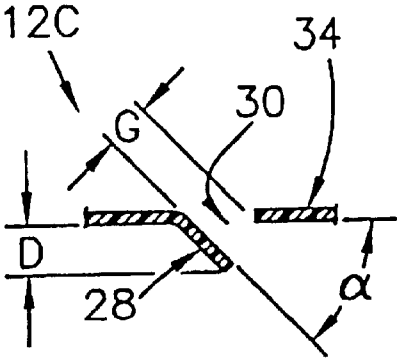
FIG. 5 is a cross-sectional side view of a detail of the side inlet shown in FIG. 3.

As shown in FIG. 5, which provides a cross-sectional view of a portion of a wall 34 in the distal portion 12C, the deflector 28 extends at an angle such as angle "$\alpha$" a predetermined distance into the flow path defined by the inlet conduit. This distance is designated by the letter "D" in FIG. 5, and the size of the gap or opening 30 adjacent to the deflector 28 is indicated by the letter "G". Although only one deflector means is illustrated in the embodiment shown in the Figures, it is of course contemplated that more than one deflector can be used and that they can be positioned in a variety of locations and orientations.

Figure 4:
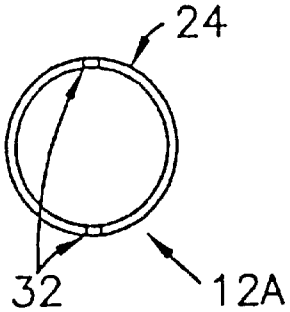
FIG. 4 is a rear end view of another portion of the side inlet shown in FIG. 1.

FIG. 4 illustrates a preferred embodiment of the proximal end of the inlet conduit. It preferably includes a pair of slots 32, or some other equivalent recess or surface, in order to facilitate rotation of the conduit within the fitting 14. In this embodiment, a tool can be positioned across slots 32 and rotated until the distal portion 12C of the inlet conduit is facing in the optimal direction, which is toward a bottom region of the water heater tank. The slots 32 themselves, or a separate indicator such as an arrow or other indicia, act to signify the orientation of the conduit with respect to the fitting and tank.

Figure 6:
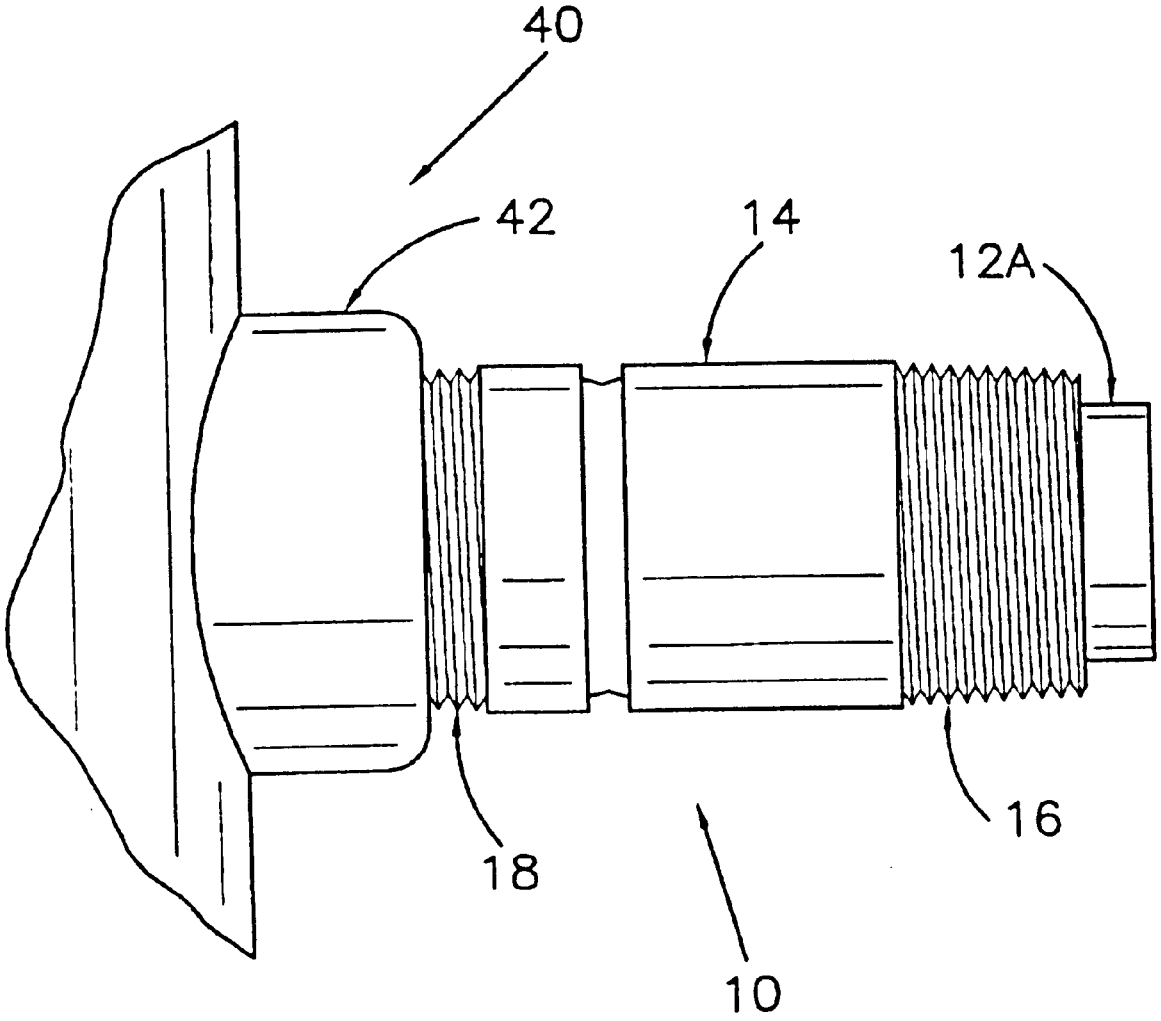
FIG. 6 is a side view of an embodiment of a water heater comprising the side inlet shown in FIG. 1.

Referring now to FIG. 6, a portion of a water heater 40 is illustrated with an inlet according to this invention as a component thereof. Water heater 40 includes an inlet spud 42 with female pipe threads (not shown). Male pipe threads 18 of fitting 14 are threaded into spud 42 in the usual manner until inlet 10 is sealingly engaged to the water heater 40. In order to install inlet 10, a pipe wrench or other tool can be used to rotate fitting 14 with respect to spud 42 to engage the threads. When the desired water-tight seal is created between the fitting and the spud, the orientation of the inlet conduit can then be adjusted utilizing the slots 32 shown in FIG. 4 so that distal portion 12C is directed toward the tank's bottom. Thereafter, the source of cold inlet water (not shown) can be connected to the male threads 16 on the proximal end portion of fitting 14. The inlet is then ready for use in operation.

Figure 7:
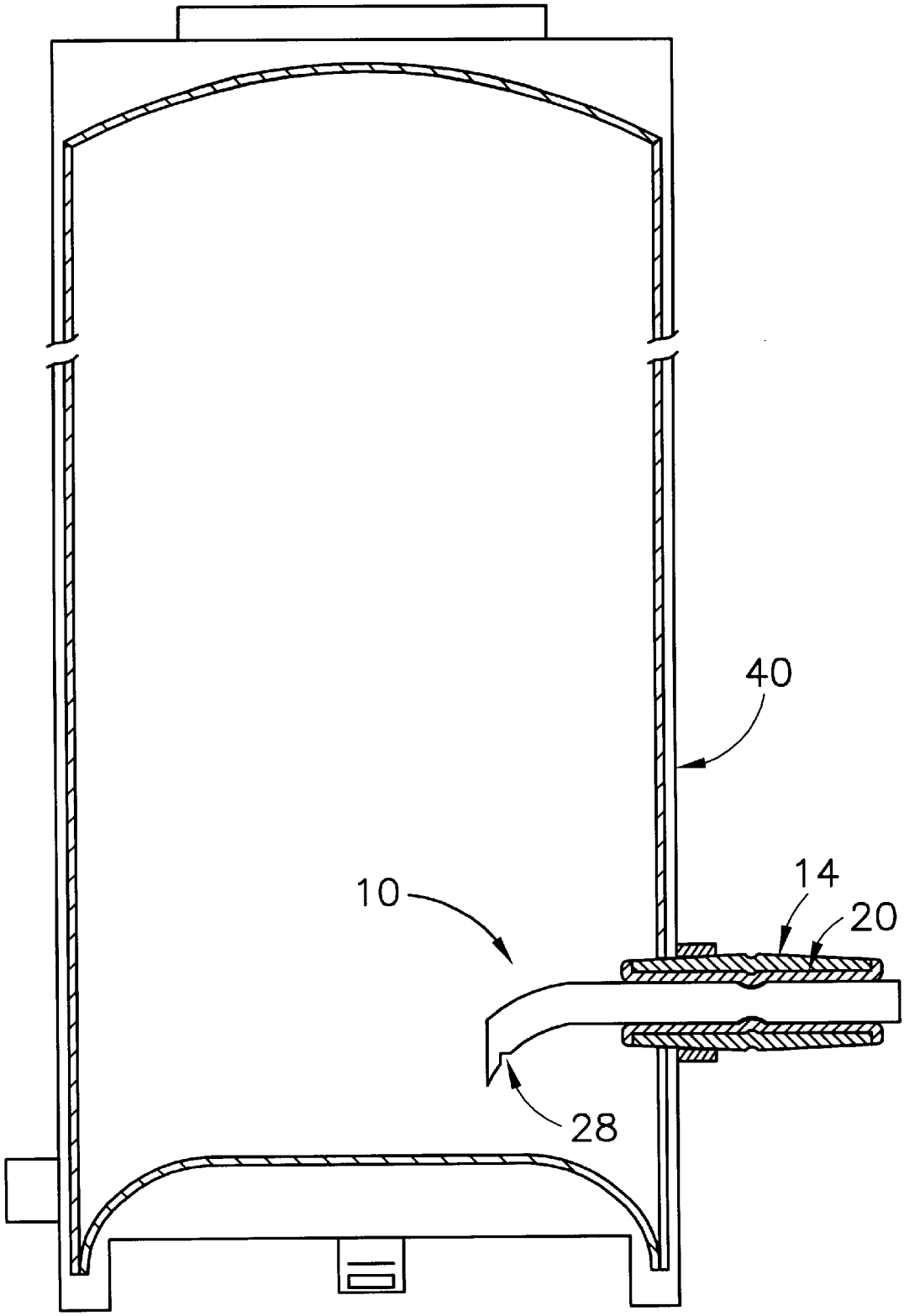
FIG. 7 is a cross-sectional side view of an embodiment of a water heater comprising the side inlet shown in FIG. 1.

FIG. 7 provides a cross-sectional side view of a water heater 40 comprising the side inlet 10 of FIGS. 1–6, and showing the inlet conduit, deflector 28, dielectric insulator 20, and fitting 14.

The following Examples illustrate the significant benefits of an inlet according to this invention. The Examples are provided for illustrative purposes only, and they are not intended to limit the invention in any way.

EXAMPLE 1

An inlet such as the one illustrated in FIG. 1 was constructed and tested in commercial water heaters heated by gas-fired burners. The inlet was tested in comparison to a conventional side inlet that comprised a nipple connected to the tank spuds. The relative inlet performances were measured in relation to so-called "stacking" or "build-up". The stacking effect is described in U.S. Pat. No. 5,341,770, issued to Eric M. Lannes, which is incorporated herein by reference.

In this test, each water heater was allowed to heat up to a predetermined storage tank temperature of 180° F. Immediately after the main burner turned off, water was drawn off at a rate of 5 gallons per minute. The draw continued until the heater's thermostat called for heat (the main burner turned on). This cycle was repeated continuously until the measured outlet water temperature did not vary by more than 1° F. for three consecutive draws. The test results are summarized in the following Table 1.

TABLE 1

| Water Heater Capacity (gallons) | Input (BTUs) | Max. Temp. (° F.) (conventional inlet) | Temp. Gradient above 180° F. (° F.) (conventional inlet) | Max. Temp. (° F.) (FIG. 1 inlet) | Temp. Gradient above 180° F. (° F.) (FIG. 1 inlet) | Decrease in Temp. Gradient (%) |
|---|---|---|---|---|---|---|
| 100 | 200,000 | 198 | 18 | 196 | 16 | 11 |
| 100 | 250,000 | 205 | 25 | 195 | 15 | 40 |
| 100 | 300,000 | 201 | 21 | 196 | 16 | 24 |

The tests revealed that the temperature gradient resulting from stacking was reduced by replacing a conventional side inlet with the inlet embodiment shown in FIG. 1. The temperature gradient above the 180° F. starting point was reduced by as much as 40%.

EXAMPLE 2

An inlet such as the one illustrated in FIG. 1 was tested in commercial storage-type water heaters. The inlet was tested in comparison to a conventional side inlet, as in Example 1, to measure relative inlet performance in relation to so-called "draw-off ability", which is the ability of the storage water heater to deliver as much water as possible before the water's outlet temperature drops below a predetermined temperature.

In this test, each storage water heater was allowed to heat up to a predetermined storage tank temperature of 180° F. Once the burners turned off, they were disconnected from the water heater's thermostat. Water was then drawn off at a rate of about 5 gallons per minute and the temperature of the outlet water was measured along with its volume. The draw was continued until the outlet temperature dropped to about 150° F. The test results are summarized in the following Table 2.

TABLE 2

| Storage Water Heater Capacity (gallons) | Input (BTUs) | Drawn-off Volume (gallons) (conventional inlet) | Drawn-off Volume (gallons) (FIG. 1 inlet) | Volumetric Increase (gallons) |
|---|---|---|---|---|
| 75 | 160,000 | 46 | 60 | 14 |
| 80 | 250,000 | 62 | 72 | 10 |
| 100 | 250,000 | 87 | 94 | 7 |
| 100 | 300,000 | 89 | 92 | 3 |

The tests revealed that the drawn-off volume before reaching 150° F. was increased by replacing a conventional side inlet with the inlet embodiment shown in FIG. 1. The drawn-off volume was increased by as much as 14 gallons (30%).

EXAMPLE 3

An inlet such as the one illustrated in FIG. 1 was further tested in commercial water heaters in relation to so-called "burner on time". The amount of elapsed time was measured between burner shut-off and actuation of the thermostat to call for heat. The test was similar to the test described in Example 2 except, instead of measuring the water temperature, the time until the thermostat calls for heat was measured. The results of this test are summarized in Table 3.

TABLE 3

| Water Heater Storage Capacity (gallons) | Input (BTUs) | Elapsed Time (seconds) (conventional inlet) | Elapsed Time (seconds) (FIG. 1 inlet) | Time Increase (seconds) |
|---|---|---|---|---|
| 75 | 160,000 | 71 | 75 | 4 |
| 80 | 250,000 | 125 | 126 | 1 |
| 100 | 250,000 | 171 | 192 | 21 |
| 100 | 300,000 | 343 | 403 | 60 |
| 75 | 300,000 | 429 | 443 | 14 |

This test revealed that the amount of time in between the point when the burners are turned off and the point when the thermostat later calls for heat was significantly increased by replacing a conventional side inlet with the inlet embodiment shown in FIG. 1. The time was increased by as much as 60 seconds (17%), which is expected to reduce thermostat cycling and tank fatigue.

The exact reason for these significant benefits is not certain. Nevertheless, it is speculated that the shape of the inlet conduit, together with the utilization of means for deflecting the water flow path, creates a beneficial flow pattern. It is similar to the flow pattern created when one places a finger or thumb over the end of a hose to modify the flow path. This so-called "hose spray effect" encourages water circulation throughout the water heater's tank. It also reduces the temperature gradients that tend to be generated in such tanks.

Although this invention has been described with reference to specific forms selected for illustration in the drawings, and with respect to various modifications thereof, it will be appreciated that many other variations may be made without departing from the feature of reducing the generation of temperature gradients within a water heater tank. All such variations, including the substitution of equivalent elements or materials for those specifically shown and described, are within the spirit and scope of the invention as defined in the appended claims.

What is claimed is:

1. A side inlet connected for delivering water into a water heater tank through a side wall of said tank, adjacent the water tank bottom, said inlet comprising:

an inlet conduit comprising a proximal portion defining a flow opening for water flow into said inlet conduit, an intermediate conduit portion extending from said proximal portion and defining a flow passage for said water flow, and a distal conduit portion having an axis extending from said intermediate portion and provided with a flow opening for said water flow from said inlet conduit;

deflecting means extending within said distal portion of said inlet conduit and extending into said water flow for deflecting said water flow;

wherein said intermediate portion of said inlet conduit extends toward an interior region of said tank, and said distal portion of said inlet conduit is angled downwardly toward the bottom of said tank;

wherein said flow opening is oriented at an angle to the axis of said distal portion;

wherein said angle is an acute angle, such that said flow opening faces toward a central region of said tank; and wherein said distal portion of said inlet conduit, said flow opening for said water flow form said inlet conduit and said means for deflecting said water flow coact, as said water flows into said tank, to modify said water flow so as to create a spray effect, promoting water circulation within said tank, reducing the generation of temperature gradients within said tank, increasing the draw-off capacity of said water heater, and reducing thermostat cycling and tank fatigue of said water heater.

2. The inlet defined in claim 1, wherein said intermediate portion of said inlet conduit extends substantially horizontally toward said interior region of said tank upon installation of said inlet.

3. The inlet defined in claim 1, wherein said distal portion of said inlet conduit curves downwardly from said intermediate portion of said inlet conduit toward said bottom of said tank upon installation of said inlet.

4. The inlet defined in claim 1, wherein said means for deflecting said water flow comprises a surface positioned substantially adjacent to and within a wall of said distal portion of said inlet conduit and extending at an angle from said wall toward said path of said water flow.

5. The inlet defined in claim 1, further comprising a fitting engaged over said proximal portion of said inlet conduit for forming a connection between said inlet conduit and said tank wherein said inlet conduit extends through said fitting.

6. The inlet defined in claim 5, wherein said fitting comprises means for engaging said proximal portion of said inlet conduit to prevent movement of said inlet conduit in a direction along an axis of said proximal portion yet permitting rotation of said inlet conduit about said axis of said proximal portion.

7. The inlet defined in claim 6, wherein said means for engaging comprises a radially inwardly extending surface positioned to engage an outer surface of said proximal portion of said inlet conduit.

8. The inlet defined in claim 6, further comprising means positioned adjacent to said proximal portion for rotating said inlet conduit about said axis of said proximal portion for adjustment of the orientation of said distal portion of said inlet conduit with respect to said fitting upon installation of said inlet.

9. The inlet defined in claim 8, wherein said means for rotating comprises a recess positioned at a proximal end portion of said inlet conduit.

10. The inlet defined in claim 5, wherein a proximal end portion of said inlet conduit extends outwardly beyond a proximal end portion of said fitting.

11. The inlet defined in claim 5, wherein a dielectric insulator is positioned between said fitting and said inlet conduit.

12. An inlet adapted for delivering water into a tank of a water heater through a port extending through a side wall of said tank, said inlet comprising:

an inlet conduit comprising a proximal portion adapted for connection into said port, an intermediate conduit portion extending from said proximal portion and extending toward an interior region of said tank, and a distal conduit portion extending from said intermediate portion and curved toward the bottom of said tank, said proximal portion, said intermediate portion and said distal conduit portion together defining a path for water flow, and said distal portion having an end opening for said water flow from said inlet conduit and into said tank;

and a deflector extending from the wall of said distal conduit portion within said distal portion of said inlet conduit and into said path of said water flow;

said distal conduit portion wall having an opening downstream of said deflector;

wherein said end opening defined by said distal portion of said inlet conduit is oriented at an angle to said axis of said distal portion;

wherein said angle is an acute angle such that said end opening faces toward a central region of said tank; and wherein said distal portion of said inlet conduit, said end opening and said deflector coact with said water flow to modify said water flow so as to create a spray effect to promote water circulation within said tank, reduce the generation of temperature gradients within said tank, increase draw-off capacity of said water heater and reduce thermostat cycling and tank fatigue of said water heater.

13. The inlet defined in claim 12, wherein said intermediate portion of said inlet conduit is positionable so that its axis extends in a substantially horizontal direction from said proximal portion of said inlet conduit toward said interior region of said tank.

14. The inlet defined in claim 12, wherein said distal portion of said inlet conduit is positionable so that its axis curves downwardly from said intermediate portion of said inlet conduit toward said bottom of said tank.

15. The inlet defined in claim 12, wherein said deflector comprises a surface positioned substantially adjacent to and within a wall of said distal portion of said inlet conduit and extending at an angle from said wall toward said path of said water flow.

16. The inlet defined in claim 12, further comprising a fitting engaged over said proximal portion of said inlet conduit and adapted for connecting said inlet conduit to said tank.

17. The inlet defined in claim 16, wherein said fitting comprises a radially inwardly extending surface positioned for engaging said inlet conduit to prevent movement of said inlet conduit in a direction along an axis of said proximal portion of said inlet conduit yet permitting rotation of said inlet conduit about said axis of said proximal portion.

18. The inlet defined in claim 17, further comprising a recess positioned adjacent to said proximal portion to facilitate rotation of said inlet conduit about said axis of said proximal portion of said inlet conduit to adjust the orientation of said distal portion and said end opening of said inlet conduit with respect to said fitting.

19. The inlet defined in claim 16, wherein a proximal end portion of said inlet conduit extends outwardly beyond a proximal end portion of said fitting.

20. The inlet defined in claim 16 wherein a dielectric insulator is positioned between said fitting and said inlet conduit.

21. A water heater adapted to reduce the generation of temperature gradients that tend to occur with said water heater, said water heater comprising:

a tank having a port defined in a side wall thereof;

an inlet conduit connected for water flow into said tank, said inlet conduit comprising a proximal conduit portion, an intermediate conduit portion extending from said proximal conduit portion and toward an interior region of said tank, and a distal conduit portion extending from said intermediate conduit portion toward a bottom of said tank, said proximal portion, said intermediate portion and said distal portion together defining a path for said water flow, and said distal portion defining an end opening for said water flow from said inlet conduit and into said tank;

a deflector extending from the wall of said distal conduit portion within said inlet conduit into said path of said water flow;

said distal conduit portion wall having an opening downstream of said deflectors;

a fitting engaging said proximal portion of said inlet conduit and connected to said port defined in said side wall of said tank;

wherein said flow opening is oriented at an acute angle to the axis of said distal portion, and wherein said distal portion of said inlet conduit, said flow opening for said water flow form said inlet conduit and said deflector coact to modify said flow pattern creating a spray effect that promotes water circulation within said tank, reduces the generation of said temperature gradients within said tank, increases draw-off capacity of said water heater and reduces the thermostat cycling and tank fatigue of said water heater.

22. The water heater defined in claim 21, wherein said intermediate portion of said inlet conduit extends in a substantially horizontal direction from said proximal portion toward said interior region of said tank.

23. The water heater defined in claim 21, wherein said distal portion of said inlet conduit curves downwardly from said intermediate portion toward said bottom of said tank.

24. The water heater defined in claim 21, wherein said inlet conduit is substantially tubular along said proximal portion, said intermediate portion and said distal portion.

25. The water heater defined in claim 21, wherein said deflector comprises a surface positioned adjacent to a wall of said distal portion and extending at an angle from said wall into said path of said water flow.

26. The water heater defined in claim 21, wherein said fitting engages said inlet conduit to prevent movement in a direction along an axis of said proximal portion of said inlet conduit while permitting rotation of said inlet conduit about said axis.

27. The water heater defined in claim 26, further comprising a surface positioned adjacent to said proximal portion of said inlet conduit to facilitate rotation of said inlet conduit about said axis and adjustment of the orientation of said distal portion toward said bottom of said tank.

28. The water heater defined in claim 21, wherein a proximal end portion of said inlet conduit extends outwardly beyond a proximal end portion of said fitting.

29. The water heater defined in claim 21, said water heater further comprising a dielectric insulator positioned between said fitting and said inlet conduit.

* * * * *

UNITED STATES PATENT AND TRADEMARK OFFICE

CERTIFICATE OF CORRECTION

PATENT NO. : 5,943,984
DATED : August 31, 1999
INVENTOR(S) : Eric M. Lannes

It is certified that error appears in the above-identified patent and that said Letters Patent is hereby corrected as shown below:

In Column 8 at line 38 after "opening" please insert -- for said water flow from said inlet conduit -- .

In Column 10 at line 53 after "opening" please insert -- for said water flow from said inlet conduit -- ; and on line 56 please change "form" to -- from -- .

Signed and Sealed this

Twenty-fifth Day of July, 2000

*Attest:*

*Attesting Officer*

Q. TODD DICKINSON

*Director of Patents and Trademarks*